US007234976B2

(12) United States Patent
Takeda et al.

(10) Patent No.: US 7,234,976 B2
(45) Date of Patent: Jun. 26, 2007

(54) TERMINAL COVER, SEALED TYPE ELECTROMOTIVE COMPRESSOR PROVIDED WITH THE TERMINAL COVER, AND REFRIGERANT CYCLE DEVICE IN WHICH THE SEALED TYPE ELECTROMOTIVE COMPRESSOR CONSTITUTES REFRIGERANT CIRCUIT

(75) Inventors: Katsuyuki Takeda, Fujioka (JP); Kazuaki Fujiwara, Ota (JP)

(73) Assignee: Sanyo Electric Co., Ltd., Moriguchi-shi (JP)

( * ) Notice: Subject to any disclaimer, the term of this patent is extended or adjusted under 35 U.S.C. 154(b) by 0 days.

(21) Appl. No.: 11/349,075

(22) Filed: Feb. 8, 2006

(65) Prior Publication Data

US 2006/0175914 A1 Aug. 10, 2006

(30) Foreign Application Priority Data

Feb. 8, 2005 (JP) ..... 2005/031438

(51) Int. Cl.
*H01R 33/72* (2006.01)

(52) U.S. Cl. ..... 439/685; 439/686; 439/694; 439/597; 439/599

(58) Field of Classification Search ..... 439/685, 439/686, 694, 597, 599, 687, 689, 690
See application file for complete search history.

(56) References Cited

U.S. PATENT DOCUMENTS

| | | | | |
|---|---|---|---|---|
| 1,735,731 | A * | 11/1929 | Cunningham | 439/252 |
| 1,757,437 | A * | 5/1930 | Muldoon | 439/687 |
| 3,213,406 | A | 10/1965 | Just et al. | 339/18 |
| 4,740,177 | A * | 4/1988 | Heimbrock | 439/596 |
| 5,131,858 | A | 7/1992 | Heimbrock | 439/181 |
| 5,863,364 | A * | 1/1999 | Lin et al. | 156/73.1 |
| 6,305,989 | B1 * | 10/2001 | Quadir | 439/685 |
| 7,108,565 | B2 * | 9/2006 | Boischio | 439/694 |
| 2002/0049004 | A1 * | 4/2002 | Davis et al. | 439/685 |
| 2006/0116028 | A1 * | 6/2006 | Boischio | 439/694 |

FOREIGN PATENT DOCUMENTS

| | | |
|---|---|---|
| EP | 0 779 683 A1 | 6/1997 |
| GB | 2 125 238 A | 2/1984 |
| JP | 5-126048 | 5/1993 |

* cited by examiner

*Primary Examiner*—Gary F. Paumen
(74) *Attorney, Agent, or Firm*—Armstrong, Kratz, Quintos, Hanson & Brooks, LLP

(57) ABSTRACT

An object is to provide a terminal cover which can be easily attached to a cluster while securely holding the cluster and which can protect lead wires extending from the cluster, a sealed type electromotive compressor whose terminal is covered with the terminal cover, and a refrigerant cycle device whose refrigerant circuit is constituted of the sealed type-electromotive compressor. The terminal cover comprises: a storage section which is depressed so as to contain a cluster electrically connected to the terminal and whose terminal-side face opens; and a recessed portion which is formed in a side wall inner portion connected to an opening of the storage section and which is to engage with a protruding portion protruding from the cluster, and an opening edge of the storage section is provided with a cut which corresponds to a terminal-side position of the recessed portion.

6 Claims, 6 Drawing Sheets

TERMINAL COVER, SEALED TYPE ELECTROMOTIVE COMPRESSOR PROVIDED WITH THE TERMINAL COVER, AND REFRIGERANT CYCLE DEVICE IN WHICH THE SEALED TYPE ELECTROMOTIVE COMPRESSOR CONSTITUTES REFRIGERANT CIRCUIT

BACKGROUND OF THE INVENTION

The present invention relates to a terminal cover having flexibility so as to cover a terminal for supplying power to an electromotive element stored in a sealed container, a sealed type electromotive compressor whose terminal is covered with the terminal cover, and a refrigerant cycle device in which a refrigerant circuit is constituted of the sealed type electromotive compressor.

A terminal for supplying power to an electromotive element stored in a sealed container is attached to the sealed container of a sealed type electromotive compressor constituted of the electromotive element and a compression element driven by this electromotive element. In this terminal, a plurality of conductive pins are supported on a terminal main body via an insulating member. Moreover, a tip portion of each conductive pin is connected to a lead wire (see, e.g., Japanese Patent Application Laid-Open No. 5-126048).

In addition, in a case where the outside of the sealed container of such terminal remains to be exposed, there is a fear that trashes such as dust and dirt stick to the terminal, an insulating property of the conductive pin deteriorates, and the insulating member melts.

Therefore, attempts are made to solve such disadvantage by covering the sealed container of the terminal with a cover. The terminal cover will be described with reference to FIGS. 8 and 9. FIG. 8 shows a vertical side view of a terminal cover 100, and FIG. 9 shows a sectional plan view of the terminal cover 100 of FIG. 8.

As shown in FIGS. 8 and 9, in the terminal cover 100, there is formed a storage section 102 to store a cluster which is constituted by bundling lead wires and which connects the terminal conductive pins to the lead wires. Moreover, a hole to engage with the conductive pin of the terminal is formed in the surface of the cluster on a terminal side in a case where the cluster is stored in the storage section. A side wall inner portion of the storage section 102 is provided with a recessed portion 103 which corresponds to a protruding portion formed on a tip of the cluster. The protruding portion of the cluster engages with the recessed portion 103 to thereby stably hold the cluster in the storage section 102.

Moreover, in FIG. 8, reference numeral 104 denotes a removal port for removing the lead wires extending from the cluster, and 105 denotes a stepped portion formed in order to prevent the cluster from being moved toward the removal port, the cluster being stored in the storage section 102 in the same manner as in the recessed portion 103.

In addition, since the above-described protruding portion is formed on the cluster, it is difficult to store the cluster in the storage section 102 of such terminal cover 100. That is, to store the cluster, unless the terminal cover 100 is strongly pulled in a horizontal direction (arrow direction of FIG. 9) to expand the storage section 102, the protruding portion cannot be stored in the recessed portion 103.

However, when the terminal cover 100 is strongly pulled, there is a fear that the terminal cover 100 breaks. In a case where the terminal cover is constituted of a soft material in order to avoid such breakage of the terminal cover, there is a fear that the terminal cover melts owing to heat from the sealed type electromotive compressor during use.

On the other hand, there is a problem that the lead wires extending from the removal port 104 to the outside of the terminal cover 100 are nibbled by a mouse, thereby causing short-circuit, and there has been a demand for protection of the lead wires.

SUMMARY OF THE INVENTION

The present invention has been developed to solve such conventional problems, and an object is to provide a terminal cover which can be easily attached to a cluster while securely holding the cluster, a sealed type electromotive compressor whose terminal is covered with the terminal cover, and a refrigerant cycle device whose refrigerant circuit is constituted of the sealed type electromotive compressor.

Furthermore, an object is to provide a terminal cover capable of protecting lead wires extending from a cluster, a sealed type electromotive compressor whose terminal is covered with the terminal cover, and a refrigerant cycle device whose refrigerant circuit is constituted of the sealed type electromotive compressor.

That is, in a first aspect of the present invention, a terminal cover has flexibility so as to cover a terminal for supplying power to an electromotive element stored in a sealed container, and comprises: a storage section which is depressed so as to contain a cluster electrically connected to the terminal and whose terminal-side face opens; and a recessed portion which is formed in a side wall inner portion connected to an opening of the storage section and which is to engage with a protruding portion protruding from the cluster, an opening edge of the storage section being provided with a cut which corresponds to a terminal-side position of the recessed portion.

In a second aspect of the present invention, the terminal cover further comprises: a holding portion which holds a tip of a guard wound around peripheries of lead wires extending from the cluster.

In a sealed type electromotive compressor of a third aspect of the present invention, a terminal is covered with the terminal cover of the above-described inventions.

In a refrigerant cycle device of a fourth aspect of the present invention, a refrigerant circuit is constituted of the sealed type electromotive compressor of the above-described invention.

According to the terminal cover of the first aspect of the present invention, since the cut is formed which corresponds to the terminal-side position of the recessed portion, the protruding portion of the cluster can be easily engaged with the recessed portion via the cut.

Consequently, the cluster can be easily stored in the storage section via the opening of the storage section of the terminal cover. Moreover, it is possible to solve a disadvantage that the terminal cover breaks during the storing of the cluster. Alternatives of a material for use in the terminal cover can be increased.

Furthermore, there is disposed the holding portion which holds the tip of the guard wound around the peripheries of the lead wires extending from the cluster as in the second aspect of the present invention. Consequently, the lead wires can be protected by the guard, and deviation of the guard can be prevented.

Consequently, the peripheries of the lead wires extending to the outside of the terminal cover are always wound with the guard, and the guard can securely protect the lead wires.

Moreover, as in the third aspect of the present invention, the terminal of the sealed type electromotive compressor is covered with the terminal cover of each of the above-described inventions. Consequently, it is possible to improve performance and reliability of the sealed type electromotive compressor.

Furthermore, since the refrigerant circuit of the refrigerant cycle device is constituted of the sealed type electromotive compressor of the above-described invention as in the fourth aspect of the present invention, the performance and the reliability of the whole refrigerant cycle device can be improved.

DETAILED DESCRIPTION OF THE PREFERRED EMBODIMENT

Figure 1:
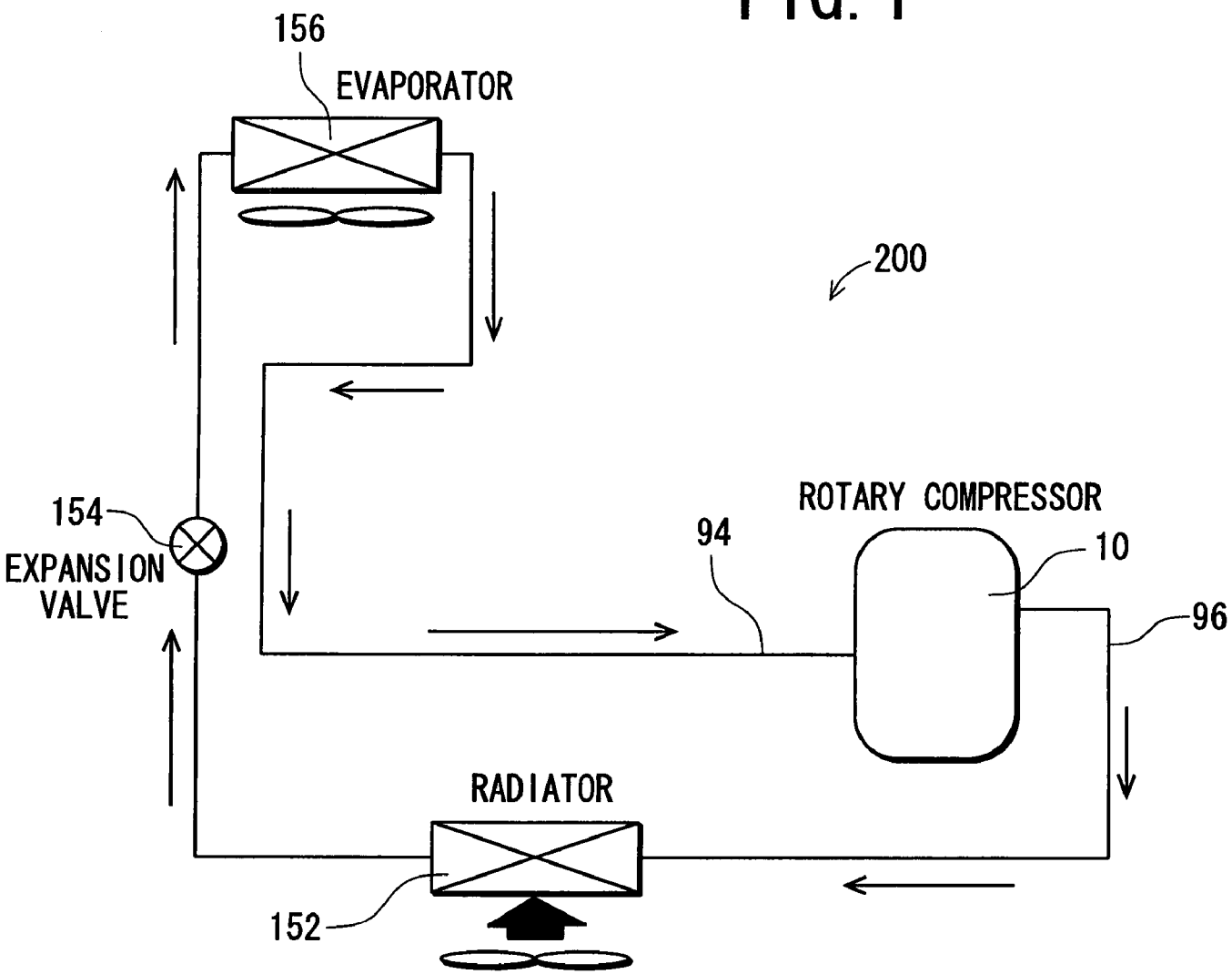
FIG. 1 is a refrigerant circuit diagram of a refrigerant cycle device in which a refrigerant circuit is constituted of a rotary compressor provided with a terminal cover in one embodiment of the present invention.

There will be described hereinafter an embodiment of a terminal cover of the present invention in detail with reference to the drawings. FIG. 1 is a refrigerant circuit diagram of a refrigerant cycle device 200 in which a refrigerant circuit is constituted of a rotary compressor 10 (sealed type electromotive compressor) provided with a terminal cover 1 in one embodiment of the present invention.

In the present embodiment, the refrigerant circuit of the refrigerant cycle device 200 is constituted by annularly connecting the rotary compressor 10, a radiator 152, an expansion valve 154 as throttle means, and an evaporator 156 to one another via piping.

That is, a refrigerant discharge tube 96 of the rotary compressor 10 is connected to an inlet to the radiator 152. A pipe connected to an outlet of the radiator 152 is connected to the expansion valve 154, and a pipe extending from the expansion valve 154 is connected to the evaporator 156. An outlet side of the evaporator 156 is connected to a refrigerant introducing tube 94 of the rotary compressor 10.

Figure 2:
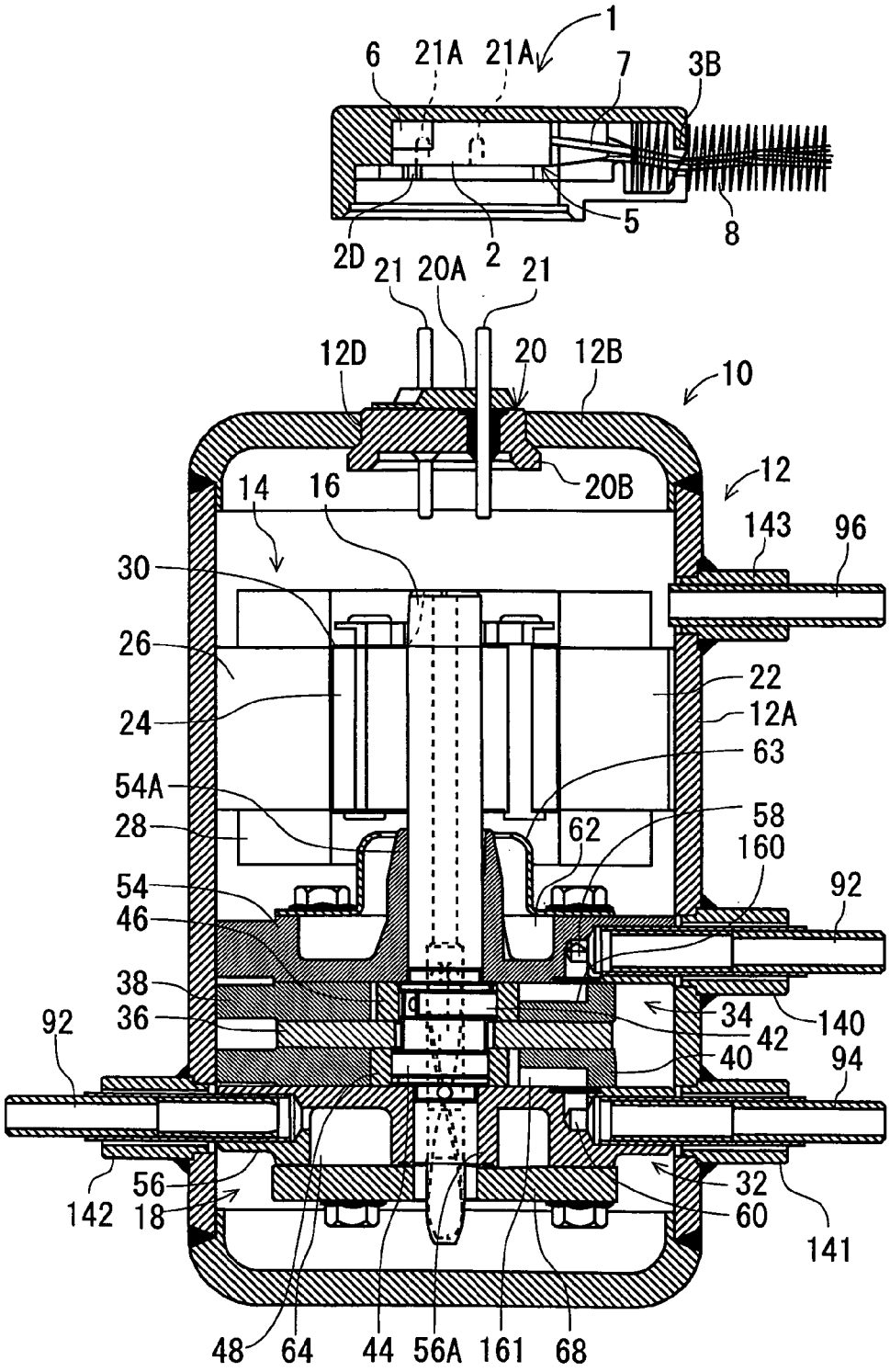
FIG. 2 is a vertical side view of the rotary compressor whose terminal is covered with the terminal cover in one embodiment of the present invention.

In the present embodiment, as the sealed type electromotive compressor whose terminal 20 is covered with the terminal cover 1 of the present invention, there is used the rotary compressor 10 provided with first and second rotary compression elements 32, 34. FIG. 2 is a vertical side view of the rotary compressor 10 whose terminal 20 is covered with the terminal cover 1 of the present invention.

In FIG. 2, in the rotary compressor 10 of the present embodiment, a vertical type cylindrical sealed container 12 made of a steel plate contains: an electromotive element 14 disposed in an upper part of an inner space of this sealed container 12; and a rotary compression mechanism section 18 disposed under this electromotive element 14 and constituted of the first and second rotary compression elements 32, 34 driven via a rotation shaft 16 of the electromotive element 14. Moreover, the rotary compressor 10 is a so-called high inner pressure type rotary compressor which compresses a refrigerant compressed by the first rotary compression element 32 by means of the second rotary compression element 34 to discharge the refrigerant into the sealed container 12.

A bottom portion of the sealed container 12 is constituted as an oil reservoir. The sealed container includes: a container main body 12A which contains the electromotive element 14 and the rotary compression mechanism section 18; and a substantially bowl-shaped end cap (lid member) 12B which closes an upper end opening of this container main body 12A. A circular attachment hole 12D is formed in the top of this end cap 12B, and the terminal 20 (wiring line is omitted) for supplying power to the electromotive element 14 is attached to the attachment hole 12D.

The electromotive element 14 is constituted of: a stator 22 annularly welded and fixed along an inner peripheral face of the upper space of the sealed container 12; and a rotor 24 inserted and disposed at a slight interval from the inner peripheral face of this stator 22. This rotor 24 is fixed to the rotation shaft 16 which passes through the center and which extends in a vertical direction.

The stator 22 has: a laminate 26 constituted of laminated donut-shaped electromagnetic steel plates; and a stator coil 28 wound around a tooth portion of this laminate 26 by a direct winding (concentrated winding) method. The rotor 24 is formed of a laminate 30 of electromagnetic steel plates in the same manner as in the stator 22.

In the rotary compression mechanism section 18, an intermediate partition plate 36 is sandwiched, the second rotary compression element 34 as a second stage is disposed on the side of the electromotive element 14 in the sealed container 12, and the first rotary compression element 32 as a first stage is disposed on the side opposite to the electromotive element 14. That is, the rotary compression mechanism section 18 is constituted of: upper and lower cylinders 38, 40 constituting the first and second rotary compression elements 32, 34; rollers 46, 48 which are fitted into upper and lower eccentric sections 42, 44 disposed on the rotation shaft 16 and which eccentrically rotate in the respective cylinders 38, 40; vanes (not shown) which abut on the respective rollers 46, 48, respectively, to define low-pressure and high-pressure chamber sides in the cylinders 38, 40; and upper and lower support members 54, 56 which close an upper opening of the upper cylinder 38 and a lower opening of the lower cylinder 40 and which include bearings 54A, 56A of the rotation shaft 16. It is to be noted that the upper and lower eccentric sections 42, 44 are disposed on the rotation shaft 16 with a phase difference of 180 degrees.

The lower cylinder 40 is provided with a suction port 161 which connects a suction passage 60 formed in the lower support member 56 to a lower-pressure chamber in the lower cylinder 40. The upper cylinder 38 is similarly provided with a suction port 160 which connects a suction passage 58 formed in the upper support member 54 to the low-pressure chamber in the lower cylinder 40.

Moreover, an outer (lower) face of the lower support member 56 on the side opposite to the lower cylinder 40, that is, an outer face of the bearing 56A is depressed, and this depressed portion is closed with a lower cover 68 to form a discharge noise absorbing chamber 64. Similarly, a (upper) face of the upper support member 54 on the side opposite to the upper cylinder 38 is depressed, and this depressed portion is closed with an upper cover 63 to form a discharge noise absorbing chamber 62.

On the other hand, the upper cover 63 is provided with a communication path (not shown) which connects the discharge noise absorbing chamber 62 to the inside of the sealed container 12, and a high-temperature high-pressure refrigerant gas compressed by the second rotary compression element 34 is discharged from this communication path into the sealed container 12.

Moreover, on a side face of the container main body 12A of the sealed container 12, sleeves 140, 141, 142, and 143 are welded and fixed to corresponding positions above the suction passages 58, 60 of the upper and lower support members 54, 56, the discharge noise absorbing chamber 64, and the electromotive element 14. The sleeves 140 and 141 are vertically adjacent to each other, and the sleeve 142 is substantially diagonally disposed with respect to the sleeve 141.

One end of a refrigerant introducing tube 92 for introducing a refrigerant gas into the upper cylinder 38 is inserted into the sleeve 140, and communicates with the suction passage 58 of the upper cylinder 38. This refrigerant introducing tube 92 passes through the upper part of the sealed container 12 to reach the sleeve 142. The other end of the tube is inserted into the sleeve 142 to communicate with the discharge noise absorbing chamber 64.

Moreover, one end of the refrigerant introducing tube 94 for introducing the refrigerant gas into the lower cylinder 40 is inserted into the sleeve 141, and communicates with the suction passage 60 of the lower cylinder 40. The refrigerant discharge tube 96 is inserted into the sleeve 143, and one end of the refrigerant discharge tube 96 communicates with the inside of the sealed container 12.

On the other hand, the terminal 20 is constituted of: a circular glass portion 20A through which an electric element (conductive pin) 21 is attached; and an iron-made attaching portion 20B which is formed around this glass portion 20A and which obliquely protrudes outwardly and downwardly in the form of a flange.

Furthermore, the terminal 20 is fixed to the end cap 12B by inserting this glass portion 20A into the attachment hole 12D from below to direct the portion upwards, and welding the attaching portion 20B to a peripheral edge of the attachment hole 12D of the end cap 12B in a state in which the attaching portion 20B is allowed to abut on the peripheral edge of the attachment hole 12D. The terminal 20 positioned outwardly in the sealed container 12 is covered with the terminal cover 1 of the present invention.

Figure 3:
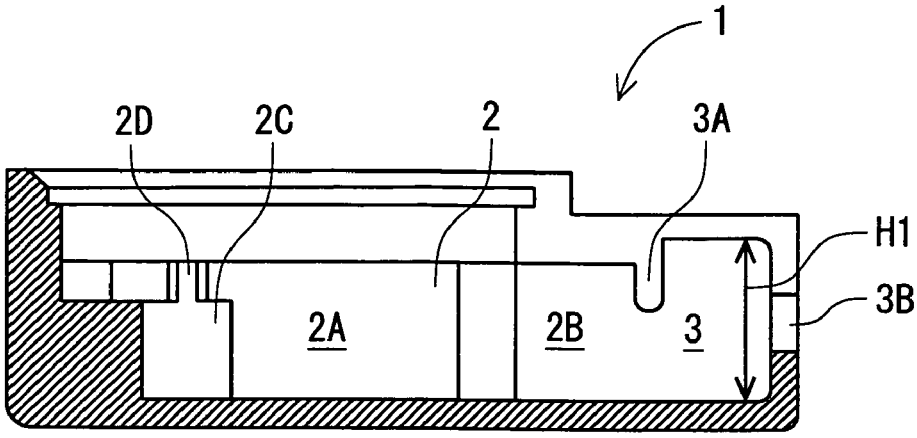
FIG. 3 is a vertical side view of the terminal cover of the present embodiment.
Figure 4:
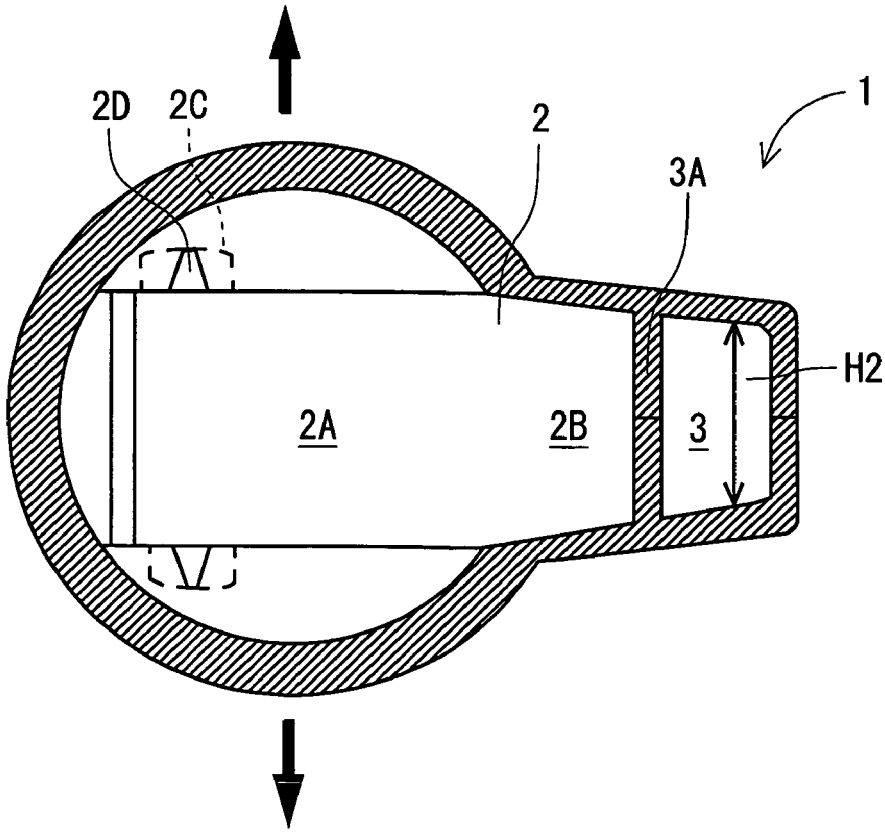
FIG. 4 is a sectional plan view of the terminal cover of FIG. 3.

Here, the terminal cover 1 of the present invention will be described with reference to FIGS. 3 and 4. FIG. 3 is a vertical side view of the terminal cover 1, and FIG. 4 is a sectional plan view of the terminal cover 1. In the present embodiment, the terminal cover 1 covers the terminal 20 for supplying power to the electromotive element 14 stored in the sealed container 12 of the rotary compressor 10, and the terminal cover is constituted of a material such as a silicon rubber having flexibility.

This terminal cover 1 is provided with a storage section 2 which is depressed so as to store a cluster 5 electrically connected to the terminal 20 and whose face opens on the side of the terminal 20. The storage section 2 is constituted of: a substantially cylindrical chamber 2A which covers an outer periphery of the terminal 20; and a substantial four-way chamber 2B. A holding portion 3 described later is formed in the chamber 2B on the side opposite to the chamber 2A. Between the storage section 2 and the holding portion 3, there is disposed a partition member 3A which partially defines the storage section 2 and the holding portion 3 on a terminal 20 side.

Moreover, in a wall face of the holding portion 3 of the terminal cover 1 on the side opposite to the storage section 2, a communication hole 3B is formed which passes through the terminal cover 1 in a horizontal direction (lateral direction) and which connects the holding portion 3 to the outside of the terminal cover 1. This communication hole 3B is a hole for removing lead wires 7 . . . extending from the cluster 5 described later.

The holding portion 3 holds a tip of a spring member 8 wound around the lead wires 7 . . . as described later. Each of a dimension (H1 in FIG. 3) of the holding portion in the vertical direction, and a dimension (H2 in FIG. 4) thereof in a horizontal direction is set to be larger than a diameter (L in FIG. 7) of the spring member 8. The partition member 3A is partially disposed between the storage section 2 and the holding portion 3 on the side of the terminal 20 as described above. The upright partition member 3A is formed from the face of the terminal cover 1 on the terminal 20 side in the vertical direction. Moreover, according to the partition member 3A, in a case where the spring member 8 is stored in the holding portion 3, the tip of the spring member 8 can be securely held in the holding portion 3 without moving the spring member 8 toward the holding portion 3. The communication hole 3B is substantially disposed in a central portion of the holding portion 3 in the horizontal and vertical directions. The communication hole 3B is positioned in the center of the diameter (L in FIG. 7) of the spring member 8 in a case where the spring member 8 is stored in the holding portion 3.

Furthermore, on the terminal 20 side of the partition member 3A and the communication hole 3B, the center of the terminal cover 1 in the horizontal direction (H2 direction of FIG. 4) is cut in the vertical direction (H1 direction of FIG. 3). A recessed portion 2C to engage with a protruding portion 6 of the cluster 5 is formed in a side wall inner portion of the chamber 2A of the storage section 2 on the side opposite to the chamber 2B. The side wall inner portion is connected to the opening of the chamber 2A on the terminal 20 side. Furthermore, a cut 2D is formed in an opening edge of the storage section 2 on the terminal 20 side of the recessed portion 2C.

Figure 5:
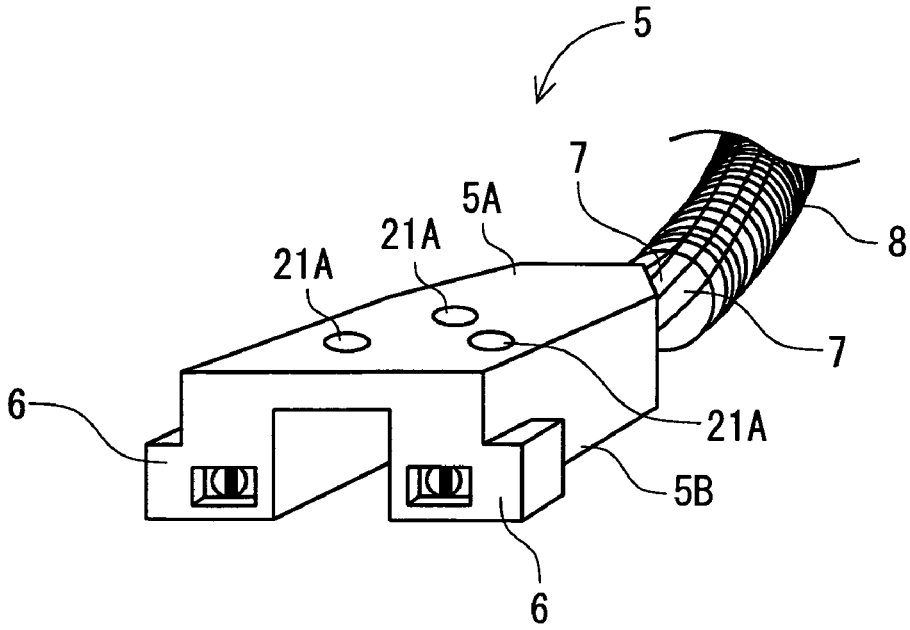
FIG. 5 is a perspective view of a cluster to be stored in the terminal cover of FIG. 3.

On the other hand, the above-described cluster 5 bundles a plurality of lead wires 7 . . . to connect the lead wires to the electric element 21 of the terminal 20. Moreover, as shown in FIG. 5, one face 5A is provided with holes 21A . . . for the electric elements 21 . . . of the terminal 20. When the terminal 20 is covered with the terminal cover 1, the electric elements 21 . . . of the terminal 20 engage in the holes 21A . . . A tip portion of the other face 5B is provided with the protruding portion 6 protruding in the horizontal direction (left and right direction in FIG. 5). Each protruding portion 6 engages in the recessed portion 2C formed in the storage section 2.

Moreover, peripheries of the lead wires 7 . . . extending from the cluster 5 are wound with the spring member 8 which is a guard. A predetermined interval is constituted between the spring member 8 and the lead wires 7 . . . (diameter direction).

Here, to attach the cluster 5 to the storage section 2 of the terminal cover 1, first the terminal cover 1 is slightly pulled in the horizontal direction (direction shown by arrows in FIG. 4).

Figure 6:
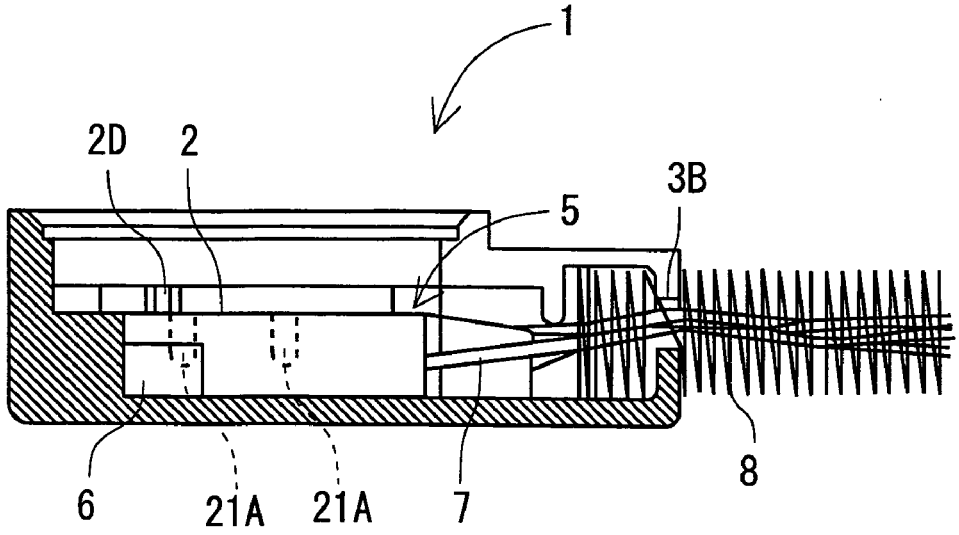
FIG. 6 is a vertical side view of the terminal cover in a state in which the cluster of FIG. 5 is stored.
Figure 7:
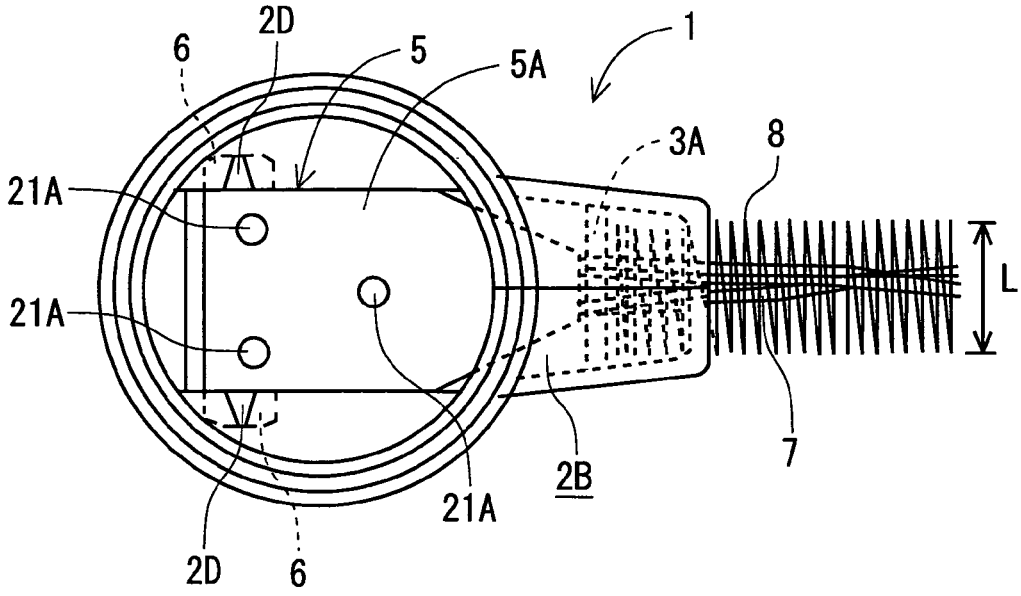
FIG. 7 is a sectional plan view of the terminal cover of FIG. 6.

This expands incisions of the wall face of the terminal cover 1 on the terminal 20 side of the partition member 3A and the communication hole 3B and the cut 2D. Therefore, the cluster 5 is inserted via the terminal 20 side opening, and forced into the storage section 2. In this case, the tip of the spring member 8 is positioned in the holding portion 3. Accordingly, the cluster 5 is stored in the storage section 2 of the terminal cover 1 as shown in FIGS. 6 and 7. It is to be noted that FIG. 6 is a vertical side view of the terminal cover 1 in a state in which the cluster 5 is stored, and FIG. 7 is a sectional plan view of FIG. 6.

Figure 8:
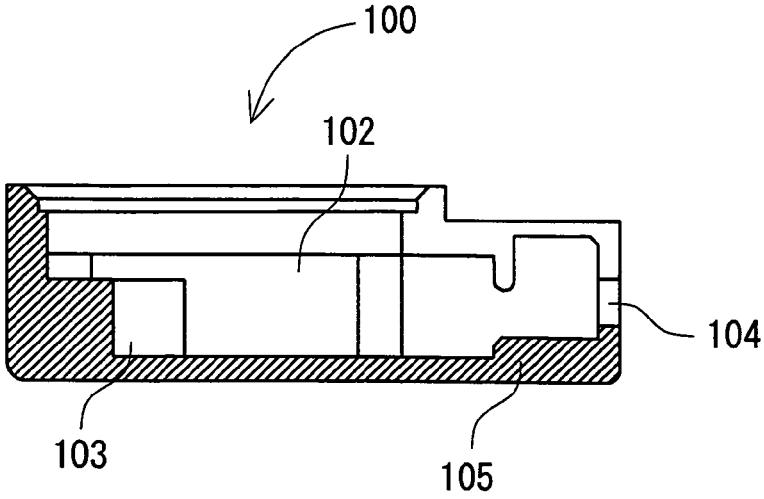
FIG. 8 is a vertical side view of a conventional terminal cover.
Figure 9:
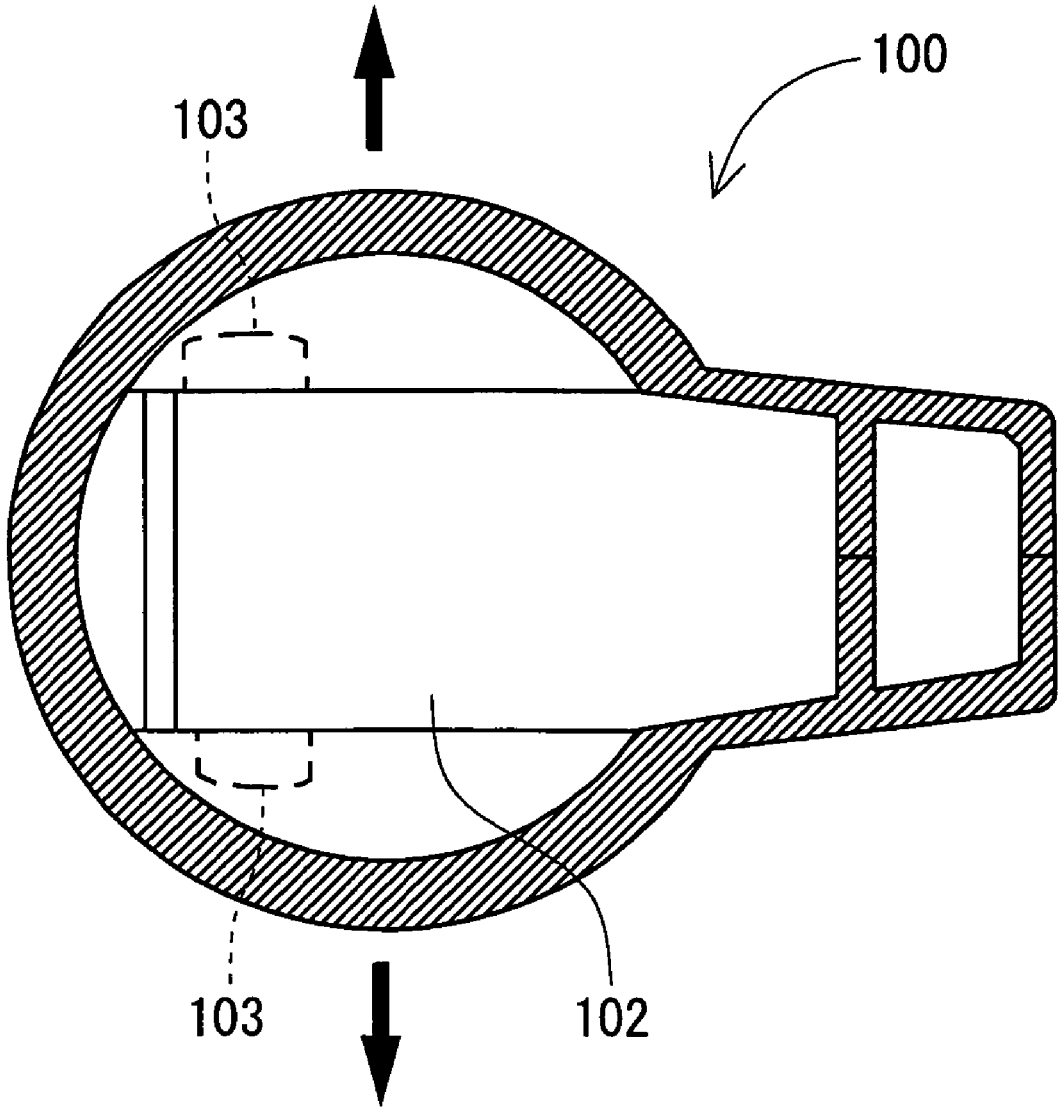
FIG. 9 is a sectional plan view of the terminal cover of FIG. 8.

Here, a conventional terminal cover will be described with reference to FIGS. 8 and 9. FIG. 8 is a vertical side view of a conventional terminal cover 100, and FIG. 9 is a sectional plan view of the terminal cover 100. As shown in the drawings, in the conventional terminal cover 100, any cut is not formed in a terminal 20 side position of a recessed portion 103, and it has been difficult to attach the cluster 5 to the terminal cover 100. That is, to store the cluster 5 in the terminal cover 100, unless the terminal cover 100 is strongly pulled and expanded in the horizontal direction (arrow directions in FIG. 9), the protruding portion 6 of the cluster 5 cannot be engaged into the recessed portion 103. There is a fear that the terminal cover 100 breaks during the storing of the cluster 5.

On the other hand, in a case where the terminal cover 100 is constituted of a soft material which is not broken even if strongly pulled in order to avoid the above-described breakage of the terminal cover, when heat generated in the rotary compressor 10 is transmitted to the terminal cover during the use, the terminal cover 100 might melt.

To solve the problem, when the cut 2D is formed in the terminal 20 side position of the recessed portion 2C in the opening edge of the storage section 2 as in the present invention, the cluster 5 can be stored without strongly pulling the terminal cover 1 in the horizontal direction. That is, the protruding portion 6 of the cluster 5 easily enters the recessed portion 2C. Therefore, when the cluster 5 is simply pushed into the storage section 2 from the terminal 20 side, the cluster can be stored by slightly pulling the terminal cover 1 in the horizontal direction or without pulling the cover.

This can avoid a disadvantage that the terminal cover 1 breaks during the storing of the cluster 5. Since the cluster 5 can be stored via the cut 2D without strongly pulling the terminal cover 1 in this manner, the terminal cover can be constituted of a material that is harder than a conventional material. That is, it is possible to use the material harder than before, for example, a silicon rubber or the like as in the present embodiment in consideration of a resistance to heat during the use. Therefore, according to the present invention, alternatives of the material for use in the terminal cover 1 expand.

Furthermore, since there is disposed the holding portion 3 for holding the tip of the spring member 8, the spring member 8 is constantly wound around the peripheries of the lead wires 7 . . . extending to the outside of the terminal cover 1.

Since the conventional terminal cover is not provided with any space for holding the tip of the spring member 8, the tips of the lead wires 7 . . . cannot be held in the terminal cover. Even if the spring member 8 is attached in this state, the spring member moves, and it is not possible to guard all of the lead wires 7 . . . extending from the terminal cover.

Moreover, in the conventional terminal cover, a storage section 102 is provided with a stepped portion 105 in the vicinity of a removal port 104 as shown in FIGS. 8 and 9. Even if the spring member 8 is disposed on the stepped portion 105, the center of a diameter of the spring member does not agree with the removal port 104. In the terminal cover 1, the lead wires 7 . . . abut on an inner face of the spring member. Therefore, it is impossible to hold the lead wires 7 . . . stably. Even in an immediate outer portion of the removal port 104 in the terminal cover 100, the lead wires 7 . . . abut on the spring member 8. Therefore, this portion may be nibbled by a mouse.

However, when the holding portion 3 is formed as in the present invention, the spring member 8 is constantly disposed in the peripheries of the lead wires 7 . . . extending to the outside of the terminal cover 1, it is possible to prevent the above-described deviation of the spring member 8. Moreover, since the conventional stepped portion is omitted, the lead wires 7 . . . extending from the terminal cover 1 can be constantly positioned substantially in the center of the spring member 8, and a predetermined interval can be formed between the lead wires 7 . . . and the spring member 8 (in the diametric direction). In consequence, it is possible to avoid in advance the disadvantage that the lead wires 7 . . . are nibbled by the mouse.

Moreover, even in a case where the conventional stepped portion is omitted, the recessed portion 2C to be engaged with the protruding portion 6 prevents the cluster 5 from being moved in the storage section 2, and the cluster can be stably held.

Furthermore, when the terminal 20 of the rotary compressor 10 is covered with the terminal cover 1 described above in detail, it is possible to improve performance and reliability of the rotary compressor 10. Furthermore, since the refrigerant circuit of the refrigerant cycle device 200 is constituted of the rotary compressor 10, it is possible to improve performance and reliability of the whole refrigerant cycle device 200.

It is to be noted that in the present embodiment, the terminal cover 1 of the present invention is used in the terminal 20 of the high inner pressure type rotary compressor 10 provided with the first and second rotary compression elements 32, 34, but the present invention is not limited to this embodiment, and is applicable to any compressor including the sealed container to which the terminal is attached.

What is claimed is:

1. A terminal cover having flexibility to cover a terminal which supplies power to an electromotive element stored in a sealed container, the terminal cover comprising:

a storage section which is depressed so as to contain a cluster electronically connected to the terminal and whose terminal-side face opens; and a recessed portion which is formed in a side wall inner portion connected to an opening of the storage section and which is to engage with a protruding portion protruding from the cluster, an opening edge of the storage section being provided with a cut which corresponds to a terminal-side position of the recessed portion.

2. The terminal cover according to claim 1, further comprising:

a holding portion which holds a tip of a guard wound around peripheries of lead wires extending from the cluster.

3. A sealed type electromotive compressor whose terminal is covered with the terminal cover according to claim 1.

4. A refrigerant cycle device whose refrigerant circuit is constituted of the sealed type electromotive compressor according to claim 3.

5. A sealed type electromotive compressor whose terminal is covered with the terminal cover according to claim 2.

6. A refrigerant cycle device whose refrigerant circuit is constituted of the sealed type electromotive compressor according to claim 5.

* * * * *